US009257032B2

(12) United States Patent
Brenner

(10) Patent No.: US 9,257,032 B2
(45) Date of Patent: Feb. 9, 2016

(54) SYSTEM AND METHOD FOR EMERGENCY COMMUNICATION IN A TCP/IP BASED REDUNDANT FIRE PANEL NETWORK

(71) Applicant: SimplexGrinnell LP, Westminster, MA (US)

(72) Inventor: Andreas Brenner, Hohenkirchen (DE)

(73) Assignee: TOTAL WALTHER GMBH, FEUERSCHUTZ UND SICHERHEIT, Cologne (DE)

( * ) Notice: Subject to any disclaimer, the term of this patent is extended or adjusted under 35 U.S.C. 154(b) by 196 days.

(21) Appl. No.: 13/778,566

(22) Filed: Feb. 27, 2013

(65) Prior Publication Data

US 2014/0240105 A1 Aug. 28, 2014

(51) Int. Cl.

| | |
|---|---|
| ***G08B 9/00*** | (2006.01) |
| ***G08B 25/00*** | (2006.01) |
| ***G08B 25/04*** | (2006.01) |
| *G08B 17/00* | (2006.01) |

(52) U.S. Cl.

CPC ..... *G08B 25/00* (2013.01); *G08B 25/004* (2013.01); *G08B 25/04* (2013.01); *G08B 17/00* (2013.01)

(58) Field of Classification Search

None

See application file for complete search history.

(56) References Cited

U.S. PATENT DOCUMENTS

| | | | | |
|---|---|---|---|---|
| 7,436,297 | B1 * | 10/2008 | Tucker | 340/541 |
| 2012/0159237 | A1 * | 6/2012 | Skrodzki et al. | 714/5.1 |

FOREIGN PATENT DOCUMENTS

| | | | |
|---|---|---|---|
| DE | 10-2010-035476 | B3 | 2/2012 |
| EP | 2466564 | A2 | 6/2012 |
| WO | 2011/124993 | A2 | 10/2011 |

OTHER PUBLICATIONS

International Search Report and Written Opinion mail May 12, 2014 for PCT application PCT/EP2014/050840 filed Jan. 16, 2014.

* cited by examiner

*Primary Examiner* — Travis Hunnings

(74) *Attorney, Agent, or Firm* — Kacvinsky Daisak Bluni PLLC

(57) ABSTRACT

A system and method for providing emergency alarm communications in an fire panel network having a ring topology. The fire panels of the network each include an emergency interface between a panel processor and a panel transceiver. The emergency interface includes a communication link that is different from a normal TCP/IP communication link of the associated panel. The emergency interface comprises a separate communication path from the normal communication link. When normal TCP/IP communications are interrupted, the emergency interface is operable to transmit alarm signals to an adjacent panel in the network. The alarm signals may then be transmitted between subsequently connected panels and a workstation or central monitoring station via the normal TCP/IP mode. The workstation and/or central monitoring station can recognize the alarm signals as being generated by the originating panel. Other embodiments are disclosed and claimed.

23 Claims, 5 Drawing Sheets

SYSTEM AND METHOD FOR EMERGENCY COMMUNICATION IN A TCP/IP BASED REDUNDANT FIRE PANEL NETWORK

BACKGROUND OF THE INVENTION

1. Field of the Invention

The disclosure relates generally to systems and methods for communicating between components of a networked fire alarm system, and more particularly to a system and method for providing emergency alarm signaling when TCP/IP communication failures occur in a networked fire alarm system.

2. Discussion of Related Art

Alarm systems, such as fire alarm and security systems, typically include one or more centralized fire panels that receive information from various sensors that are distributed throughout a structure or area. For example, referring to FIG. 1, a typical fire alarm system 10 may include a plurality of initiating devices 12 (e.g. smoke detectors, manually-actuated pull stations, etc.) that are connected to one or more fire panels 14. During normal operation of the alarm system 10, the fire panel 14 may monitor electrical signals associated with each of the initiating devices 12 for variations that may represent the occurrence of an alarm condition. For example, a variation in a particular electrical signal may represent the detection of smoke by a smoke detector in a corresponding area, or "zone," of a building in which the smoke detector is located, and may cause the fire panel 14 to enter an alarm mode. The fire panel 14 may be configured to respond to such a condition by initiating certain predefined actions, such as activating one or more notification appliances 16 (e.g. strobes, sirens, public announcement systems, etc.) within the monitored building.

The exemplary alarm system 10 may also include a workstation 18, such as a personal computer (PC) a link to a central station or server, which is operatively connected to the fire panel 14 of the alarm system 10. For monitoring applications that involve a large number of buildings, such as a college campuses or commercial campuses, each of the buildings on the campus may have its own fire panel 14. It is often desirable in such applications to be able to monitor all of the fire panels 14 from a single site, and thus, the fire panels 14 may be part of a network, with the fire panels 14 and workstation 18 connected to the network as network nodes. In this way the workstation 18 can be located in one of the monitored buildings, or a separate building, and may be used to monitor the alarm status of all the initiating devices 12 located in all of the buildings via their respective fire panels. Although not shown, the system 10 may also include a connection to a remote central monitoring facility so that a third party monitoring service can monitor and react to alarms generated by the system.

In some cases, a network of fire panels can be built up as a redundant ring using a switch or network card in each panel to enable communication with adjacent panels. One requirement for fire panel networks is redundancy. For example, standards such as European standard "EN54—Fire Detection and Alarm Systems," require that in case of failure it is not permissible to lose more than a certain number of initiating devices upon a first failure. For EN54 this number is 512 devices. As a result, a panel having more than, for example, 512 devices or support features for more than 512 devices requires redundancy. For networked fire panels this problem is currently solved using redundant network processors and a redundant network topology. In case of a Transmission Control Protocol/Internet Protocol (TCP/IP) based network, a ring topology or other redundant topology can be built by using a TCP/IP switch or router in every fire panel which supports two redundant connections to the switch. As a result, however, the switch/router, and in some cases the network processor, represent a single point of failure. That is, if the switch/router and/or network processor fail, the fire panel is unable to process and transmit alarm signals triggered by the initiating devices coupled to that panel. This single point of failure can be avoided by using multiple switches/routers and multiple network processors so that loss of a single switch/router or a single network processor would not impact successful transmission of alarm signals to adjacent panels and the workstation or a central monitoring station. It will be appreciated, however, that providing multiple switches/routers and/or multiple processors in each panel undesirably increases the cost and complexity of the overall network.

SUMMARY OF THE INVENTION

In view of the foregoing, an elegant and relatively inexpensive method and arrangement are disclosed for enabling a fire panel to transmit alarm signals even when a single switch/router or network processor in the panel has failed.

A method is disclosed for providing emergency communication in a networked alarm system. The method may comprise: receiving, at a panel processor associated with a first fire panel, an event signal from an initiation device; and transmitting, from the panel processor, an alarm signal to a panel transceiver via an emergency interface, said alarm signal representative of said event signal; wherein the alarm is transmitted on a communication link that is different from a primary alarm signal communication link of said first fire panel.

A system is disclosed for providing emergency communication in a networked alarm system. The emergency communication system can include a panel processor and a first panel transceiver associated with a first panel. The panel processor may be configured to receive an event signal from an initiation device. The panel processor may be coupled to the panel transceiver via first and second communication links, the first communication link comprising a normal communication link, the second communication link comprising an emergency communication link. The first and second communication links can be physically separate communication links. The alarm signal may be representative of the event signal.

A fire panel is disclosed. The fire panel may comprise a panel processor, a network processor coupled between the panel processor and an a TCP/IP switch, and first and second transceivers coupled to the TCP/IP switch. The fire panel may have a normal communication mode and an emergency communication mode. In the normal communication mode, the panel processor may be configured to receive event signals from at least one initiation device via the first transceiver, and to command an alarm signal be sent to an adjacent network node via the TCP/IP switch and second transceiver. In the emergency communication mode, the panel processor may be configured to receive an event signal from an initiation device and to transmit an alarm signal to the first panel transceiver via a communication link that is different from the link containing the TCP/IP switch.

BRIEF DESCRIPTION OF THE DRAWINGS

The accompanying drawings illustrate preferred embodiments of the disclosed method so far devised for the practical application of the principles thereof, and in which.

DESCRIPTION OF EMBODIMENTS

A system and method are disclosed for enabling emergency alarm signaling between networked fire panels when a normal TCP/IP communication mode is non-functional. The system and method can communicate basic alarm information a dedicated line even when one or more components of the primary TCP/IP communication link fail.

Figure 1:
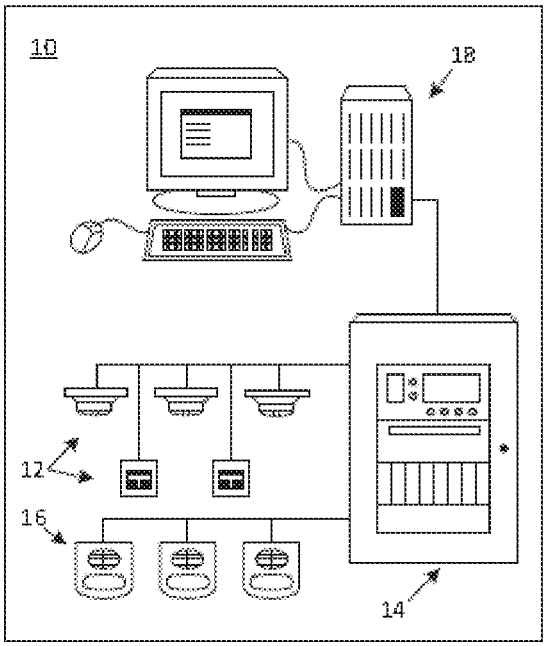
FIG. 1 is a schematic diagram illustrating an alarm system monitoring scheme.
Figure 2:
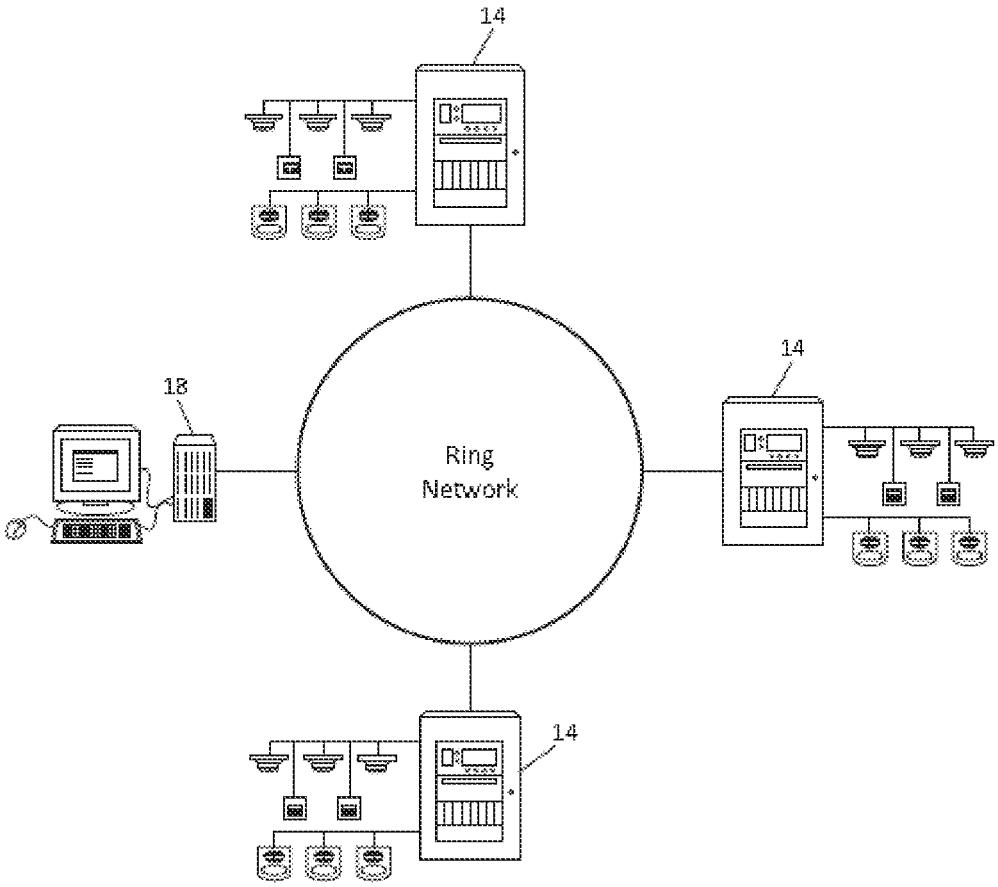
FIG. 2 is a schematic diagram illustrating an alarm system having a plurality of networked fire panels.

Referring to FIG. 2, a ring architecture can be employed to link fire panels 14 using redundant connections to a TCP/IP switch associated with each panel. With this arrangement, network information is sequentially transmitted from one node (i.e., panel 14 or workstation 18) to an adjacent node in a first direction around the ring. At each node, the network message is captured and either retransmitted as received, or modified before retransmission. If a node goes "off-line," or if the connection between nodes either shorts or opens, that node can transmit its signal in a second, opposite, direction to the previous node in the ring in order to maintain communications and to notify the network of the node's status. If, however, the TCP/IP switch fails or the network processor fails, the node may be unable to transmit information to adjacent nodes in either the first or second direction. As a result, any alarm signals received from the affected fire panel will not be retransmitted or otherwise communicated through the system to a user at a workstation or central monitoring facility.

Figure 3:
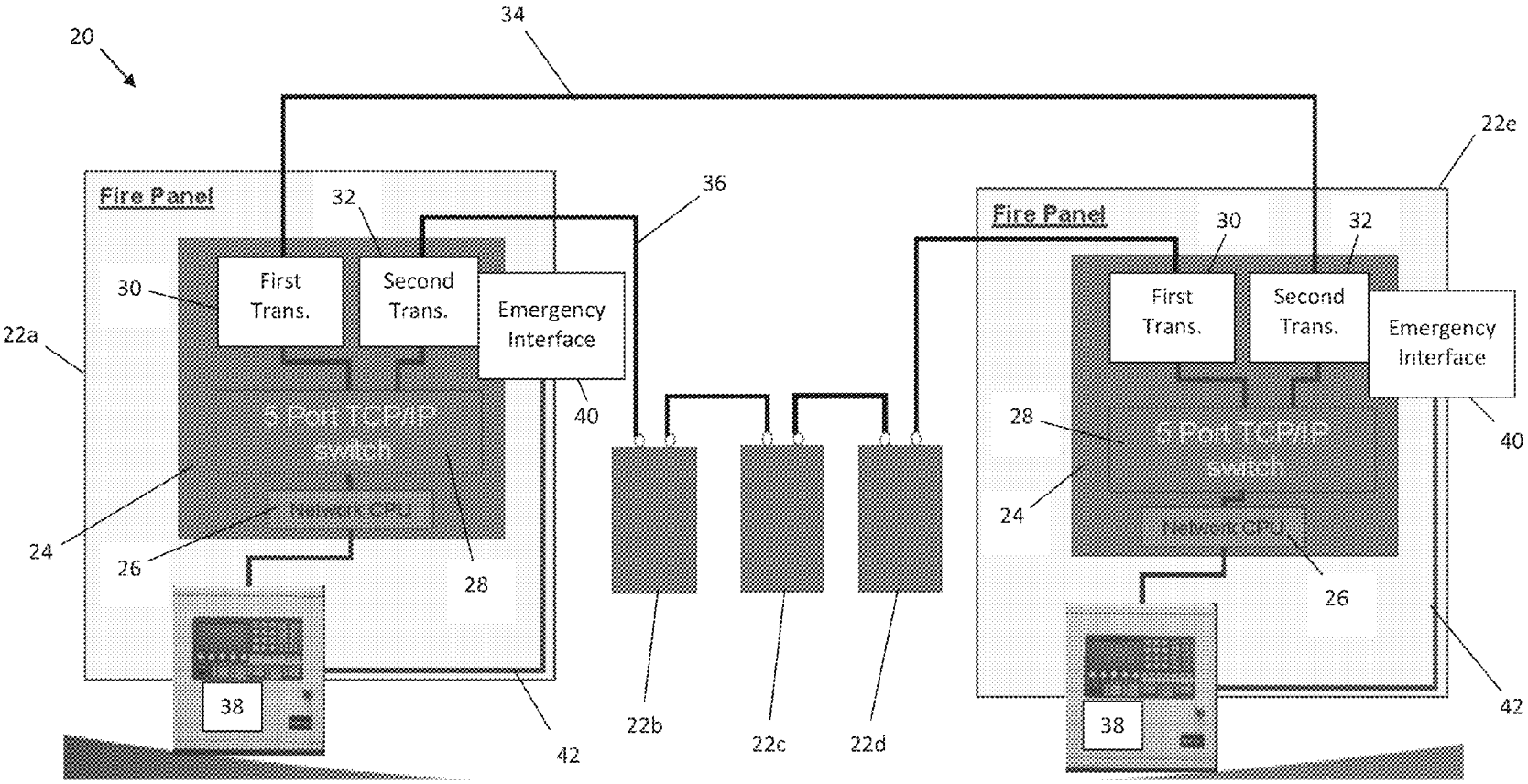
FIG. 3 is a schematic diagram illustrating an alarm system having a plurality of networked fire panels and including emergency communication functionality according to the disclosure.

Referring now to FIG. 3, a networked alarm system 20 includes a plurality of fire panels 22*a*-22*e* arranged in a ring architecture. In the illustrated embodiment the fire panels 22*a*-22*e* are fire panels, but it will be appreciated that the disclosed arrangement may also be used in any of a variety of other types of TCP/IP communications networks. Further, although FIG. 3 does not explicitly show a workstation or central monitoring facility as part of the network 20, it will be appreciated that such a workstation or central monitoring facility can be included as a network node. Each of the fire panels 22*a-e* has a network card 24 including a network processor 26, a TCP/IP switch 28, and first and second transceivers 30, 32. The first transceiver 30 is coupled via a communication link 34 to an adjacent fire panel 22*e* in a first direction around the ring, while the second transceiver 32 is coupled via a communication link 36 to another adjacent fire panel 22*b* in a second direction around the ring. An emergency interface 40 is coupled between the second transceiver 32 and a fire panel processor 38 via an emergency communication link 42. Though not explicitly shown, fire panels 22*b-d* include the same components as those described in relation to panels 22*a* and 22*e*.

The primary or normal mode of alarm communications between panels is via the TCP/IP switch 28, network processor 26, the first and second transceivers 30, 32 and the communications links 34, 36. As will be described in greater detail later, the disclosed arrangement provides an emergency communication mode in which the fire panel processor 38 senses a failure of the TCP/IP switch 28 and/or the network processor 26, and commands alarm signals directly to the second transceiver 32 via the emergency communication link 42 and the emergency interface 40. Thus, as arranged, the fire panel 22*a-e* can initiate emergency alarm communications with an adjacent fire panel using simple signals (i.e., non-TCP/IP based signals) over the communication link 36 so that an adjacent panel, including user interfaces such as connected workstations 18 can display the alarm event and transmit the event to remote locations like central monitoring stations. That is, in emergency mode the communication between the transceivers of the adjacent panels in utilize the same physical media (i.e., wires, fiber 34, 36) but simply use a different protocol (non-TCP/IP) for their communications. The panel receiving the emergency communication is configured to understand this different protocol so that it can, in turn, transmit the emergency message to other panels in the network. As a result, the affected fire panel 22*a-e* can communicate alarm messages even where the TCP/IP signaling functionality has failed. The disclosed arrangement thus complies with applicable standards such as EN54 and UL Class A which dictate that the alarm system must have the ability to communicate fire, sensor fault, panel fault and system fault conditions even in such a "degraded" mode.

The disclosed method and arrangement can be used with fire panels that communicate using any of a variety of communications technologies, a non-limiting exemplary list of which includes DSL, Ethernet and fiber-optic. Thus, in one embodiment, the first and second transceivers 30, 32 may be DSL transceivers, while the communication links 34, 36 may be DSL cable. In another embodiment, the first and second transceivers 30, 32 may be Ethernet transceivers and the communication links 34, 36 may be Ethernet cables. In yet another embodiment, the first and second transceivers 30, 32 may be fiber-optic transceivers and the communication links 34, 36 may be fiber-optic cables. Other communication links can also be used, including wireless links using any of a variety of wireless communications protocols.

As will be appreciated, the emergency signals commanded by the fire panel processor 38 and transmitted to the second transceiver 32 via the emergency interface 40 may depend on the type of communication link used. For example, when the communication links 34, 36 are DSL links, a normal (i.e., non-alarm) condition may be the presence of a 10 Volt (or other) potential difference between two wires of one of the wire pairs. An emergency alarm condition may be signaled by shorting the same two wires. When the communication links 34, 36 are Ethernet links, signaling may be via a series of predefined coded voltage pulses. One set of voltage pulses may indicate a normal non-alarm condition, while a second set of voltage pulses may indicate an emergency alarm condition. Where the communication links 34, 36 are fiber-optic links, a normal non-alarm condition may be signaled by the presence of an optical pulse/second, while an emergency alarm condition may be signaled when the optical pulse/second is not received. These are but of a few of the signal coding schemes that could be employed, and it will be appreciated that a variety of other schemes may be used in addition to, or as alternatives to, the explicitly disclosed schemes.

When the adjacent panel receives signals indicative of an alarm condition at the originating panel, the adjacent panel may then signal an associated workstation 18 and/or central monitoring station that an alarm condition has been reported by the faulty panel. This subsequent signaling can be via the normal TCP/IP protocol as the TCP/IP switch of the adjacent fire panel will be functional. It is contemplated, however, that in some instances the emergency signal can be transmitted around the ring to the workstation and/or the central monitoring station entirely via the emergency communication pathways associated with each of the fire panels.

It will be appreciated that the disclosed signaling technique may be capable of passing only limited information to the adjacent fire panel. For example, the adjacent panel 22*b* may only be able to determine that an alarm condition exists for one of the initiating devices 12 associated with the faulty panel 22*a*. The adjacent panel 22*b* may not be able to determine exactly which initiating device 12 is responsible for the alarm.

It is contemplated, however, that intelligent coding schemes may be used to pass more detailed information on to an adjacent panel. For example, the panel processor 38 may employ different types and/or series of voltage pulses, optical pulses, or voltage levels to indicate from what kind of initiation device 12 (e.g., entry alarm, smoke alarm, manual pull station) an alarm signal was received.

Figure 4:
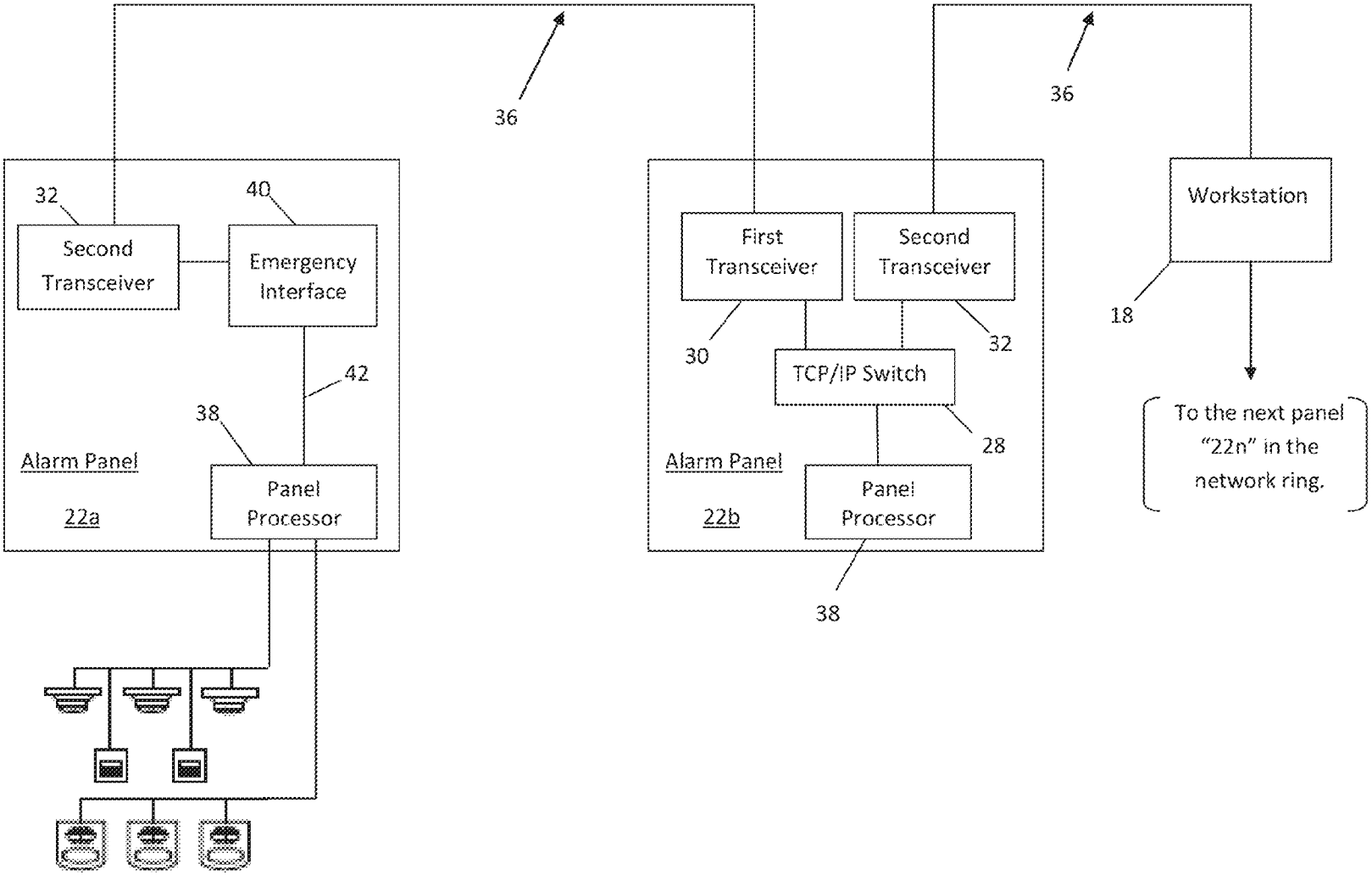
FIG. 4 is a schematic diagram highlighting an emergency communication path portion of an exemplary communications network according to the disclosure.

The emergency communication link 42 may be a simple electrical connection (e.g., wire or trace) between the panel processor 38 and the emergency interface 40 or between the panel processor 38 and the second transceiver 32 or any other link like serial connection, etc. FIG. 4 shows an exemplary emergency communication path between adjacent fire panels 14*a*, 14*b* and an associated workstation 18. Employing this arrangement, one or more of the initiating devices 12 associated with fire panel 22*a* may send an event signal to the panel processor 38. The event signal may be representative of a sensed event such as a smoke detection, heat detection, intrusion detection, pull station actuation or the like. Under a normal operating mode, an alarm signal would be transmitted around the ring via the respective transceivers and TCP/IP switches in each of the fire panels. The workstation 18 and/or central monitoring facility would receive the alarm signal and a appropriate action could be taken to address the alarm. If, however, the panel processor 38 senses that the TCP/IP switch or the network processor associated with the panel's network card is malfunctioning, the emergency operating mode can be used. In some embodiments, the panel processor 38 is in communication with the network processor 26 through an IP port to the TCP/IP switch 28. Alternatively the communication between the panel processor 38 and the network processor 26 could be via a separate data line (e.g., serial, TCP/IP etc). As a further alternative, the network processor and the panel processor may be embodied as software applications on a single processor.

As long as the panel processor 38 receives supervision signals from other panels in the network, it can determine whether the TCP/IP link (i.e., the switch 28 and network processor 26) is working.

As such, the processor 38 may send a predetermined emergency alarm signal via emergency communication link 42 to the emergency interface 40. The emergency interface 40 may pass the emergency alarm signal on to the second transceiver 32 which then transmits the signal to the first transceiver 30 of the adjacent fire panel 22*b*. The first transceiver 30 may pass the emergency alarm signal to its associated panel processor 38 for decoding. The panel processor 38 may then command an alarm signal via the TCP/IP switch 28 to be transmitted to the workstation 18 and/or central monitoring station via the second transceiver 32 of the adjacent fire panel 22*b*. Upon receiving this signal, a user at the workstation 18 or central monitoring station may be alerted to an alarm condition at the originating panel 22 so that corrective action may be taken. Since each panel in the network knows the name or address of the adjacent panels, it can transmit this identification information along to other network nodes along with the alarm information.

It will be appreciated that the emergency interface 40 may be used to signal the workstation 18 or central monitoring station of a malfunctioning TCP/IP switch or network processor even where no event signal has been received from an initiating device 12 associated with the panel 22. Thus, if the panel processor 38 senses that either the TCP/IP switch 28 or network processor 26 is not functioning, it may send a signal to an adjacent panel alerting the adjacent panel of the fault condition. The adjacent panel may then send an appropriate alert to the workstation 18 and/or central monitoring station via the normal TCP/IP communication channel indicating that a fault condition exists with respect to the originating panel.

The emergency communication link 42 and emergency interface 40 represents a distinct and separate communication route from the normal TCP/IP communication channel of the associated fire panel 22. In some embodiments the emergency interface 40 can simply be a wired connection between the panel processor 38 and the second 32. In such cases, the emergency interface may simply be the emergency communication link 42. In other embodiments, the emergency interface 40 may include a separate processor to manage emergency communications. Alternatively, the functionality associated with a separate processor may be implemented entirely in hardware.

Figure 5:
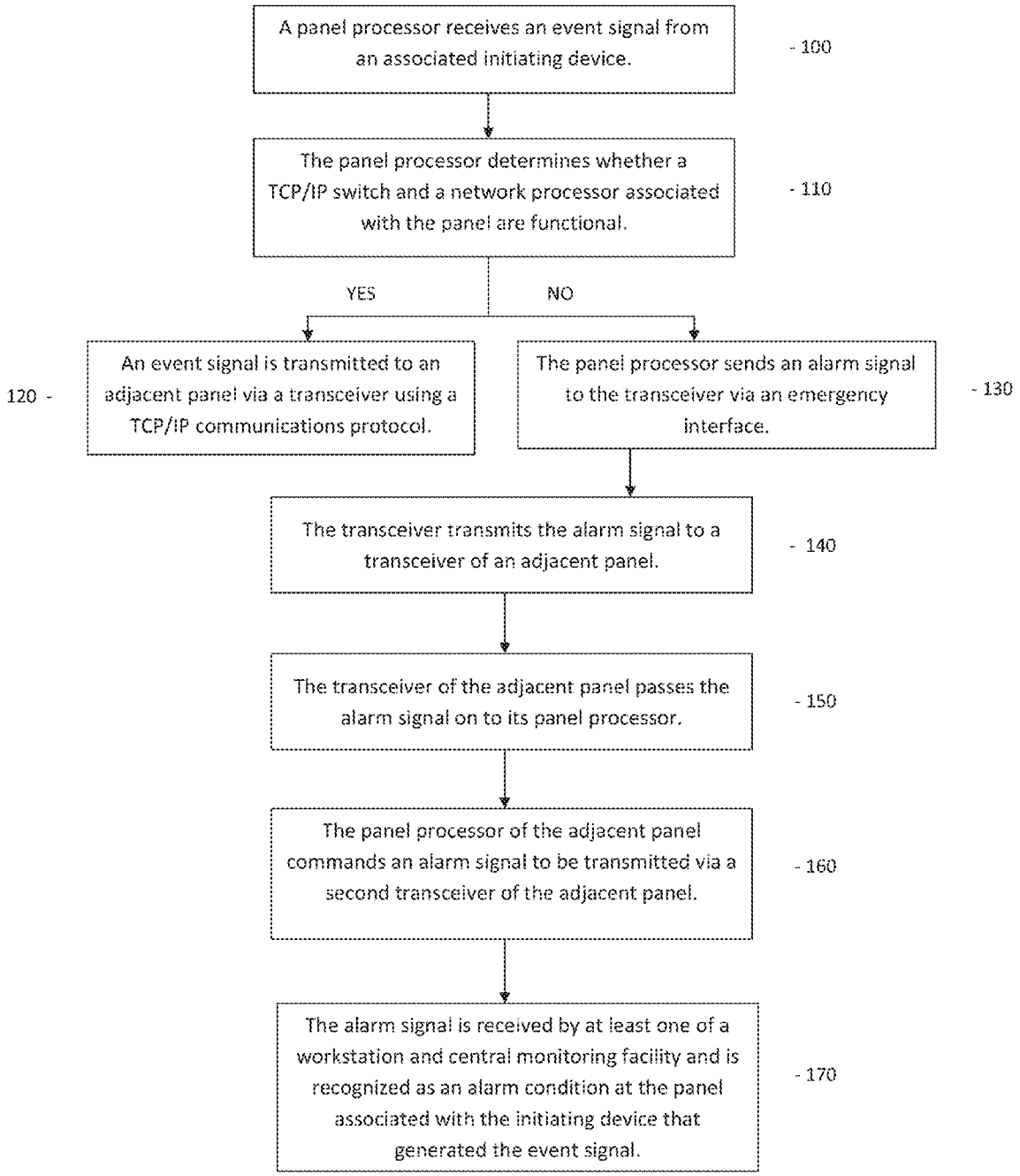
FIG. 5 is a logic diagram illustrating an exemplary embodiment of the disclosed method.

Referring now to FIG. 5, an exemplary method of operating the disclosed emergency communication system 28 will be described. At step 100, a panel processor 38 receives an event signal from an associated initiating device 12. At step 110, the panel processor 38 determines whether a TCP/IP switch 28 and a network processor 26 associated with the panel are functional. In some embodiments this determination is made when an alarm signal is received. In other embodiments the determination would be make on a constant or periodic basis. If the TCP/IP switch 28 and network processor 26 are functional then at step 120 an event signal is transmitted to an adjacent panel via a transceiver 32 using a normal communication mode. In one embodiment the normal communication mode utilizes a TCP/IP communication protocol. If one or both are determined to be malfunctioning, then at step 130 the panel processor 38 sends an alarm signal to the transceiver 32 via an emergency interface 40 using an emergency communication mode. The emergency interface may be a dedicated communication pathway between the panel processor 38 and the transceiver 32. At step 140 the transceiver 32 transmits the alarm signal to a transceiver of an adjacent panel. At step 150, the transceiver of the adjacent panel passes the signal on to its panel processor. At step 160, the panel processor of the adjacent panel commands an alarm signal to be transmitted via a second transceiver of the adjacent panel. The alarm signal from the second transceiver is transmitted according to a TCP/IP communication protocol. In some embodiments, the alarm is displayed at the adjacent panel. At step 170, the alarm signal is received by at least one of a workstation 12 and central monitoring facility and is recognized as an alarm condition at the panel associated with the initiating device that generated the event signal. In some embodiments, the alarm is received and/or displayed by all panels, workstations, and central monitoring facilities associated with the malfunctioning panel.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features. The term computer is not limited to just those integrated circuits referred to in the art as computers, but broadly refers to, microprocessors, microcontrollers, microcomputers, programmable logic controllers, application specific integrated circuits, and other programmable circuits, and these terms are used interchangeably herein.

Some embodiments of the disclosed device may be implemented, for example, using a storage medium, a computer-readable medium or an article of manufacture which may store an instruction or a set of instructions that, if executed by a machine, may cause the machine to perform a method and/or operations in accordance with embodiments of the disclosure. Such a machine may include, for example, any suitable processing platform, computing platform, computing device, processing device, computing system, processing system, computer, processor, or the like, and may be implemented using any suitable combination of hardware and/or software. The computer-readable medium or article may include, for example, any suitable type of memory unit, memory device, memory article, memory medium, storage device, storage article, storage medium and/or storage unit, for example, memory (including non-transitory memory), removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

While certain embodiments of the disclosure have been described herein, it is not intended that the disclosure be limited thereto, as it is intended that the disclosure be as broad in scope as the art will allow and that the specification be read likewise. Thus, for example, the disclosure is not limited to fire detection systems, but rather may find application in any security system which requires redundancy and which may experience limited communications in case of network failure. Therefore, the above description should not be construed as limiting, but merely as exemplifications of particular embodiments. Those skilled in the art will envision other modifications within the scope and spirit of the claims appended hereto.

What is claimed is:

1. A method for providing emergency communication in a networked alarm system, comprising:

receiving, at a panel processor associated with a first fire panel, an event signal from an initiation device;

transmitting, from the panel processor, an alarm signal to a panel transceiver via an emergency interface, said alarm signal representative of said event signal, wherein the alarm signal is transmitted to the panel transceiver on a communication link that is different from a primary alarm signal communication link of said first fire panel; and transmitting, from the transceiver, the alarm signal using an emergency communication protocol that is different from a primary communication protocol of said first alarm panel.

2. The method of claim 1, wherein the primary alarm signal communication link is a TCP/IP communication link.

3. The method of claim 1, wherein the panel transceiver is one of a DSL transceiver, an Ethernet transceiver a fiber-optic transceiver.

4. The method of claim 1, wherein the panel transceiver is a DSL transceiver, and the alarm signal comprises a short between first and second wires of a wire pair.

5. The method of claim 1, wherein the panel transceiver is an optical transceiver, and the alarm signal comprises optical pulse data.

6. The method of claim 1, wherein the panel transceiver is an Ethernet transceiver, and the alarm signal comprises voltage-coded data.

7. The method of claim 1, further comprising:

receiving, at a second panel transceiver associated with a second fire panel, the alarm signal; and transmitting, from a third panel transceiver associated with the second fire panel, a further alarm signal to at least one of a third fire panel, a network workstation and a central monitoring facility.

8. The method of claim 7, wherein the network workstation or central monitoring facility recognizes the further alarm signal as representing an alarm condition associated with the first fire panel.

9. The method of claim 7, wherein the further alarm signal includes information that identifies the first fire panel.

10. The method of claim 7, further comprising determining, at the second fire panel, whether a TCP/IP switch and network processor associated with the first fire panel are functional, and if at least one of the TCP/IP switch and the network processor are determined to be non-functional, receiving and decoding the alarm transmitted from the first fire panel.

11. A system for providing emergency communication in a networked alarm system, comprising:

a panel processor and a first panel transceiver associated with a first panel, the panel processor configured to receive an event signal from an initiation device;

the panel processor coupled to the panel transceiver via first and second communication links, the first communication link comprising a normal communication link, the second communication link comprising an emergency communication link, the first and second communication links being physically separate communication links;

wherein the alarm signal is representative of the event signal; and wherein the first panel transceiver is further configured to transmit an alarm signal to a second panel transceiver associated with a second fire panel using an emergency communication protocol that is different from a primary communication protocol of said first alarm panel.

12. The system of claim 11, wherein the primary communication link is a TCP/IP communication link.

13. The system of claim 11, wherein the first panel transceiver is a DSL transceiver, and the alarm signal comprises a short between first and second wires of a wire pair.

14. The system of claim 11, wherein the first panel transceiver is an optical transceiver, and the alarm signal comprises optical pulse data.

15. The system of claim 11, wherein the first panel transceiver is an Ethernet transceiver, and the alarm signal comprises voltage-coded data.

16. The system of claim 11, further comprising a third panel transceiver associated with the second fire panel, the third panel transceiver configured to transmit a further alarm signal to at least one of a third fire panel, a network workstation and a central monitoring facility, wherein the further alarm signal is representative of an alarm condition associated with the fire panel.

17. The method of claim 16, further comprising determining, at the second fire panel, whether a TCP/IP switch and network processor associated with the first fire panel are functional, and if at least one of the TCP/IP switch and the network processor are determined to be non-functional, receiving and decoding the alarm signal transmitted from the first fire panel.

18. The system of claim 11, wherein the first communication link includes a TCP/IP switch and a network processor coupled to the panel processor and the first panel transceiver.

19. A fire panel, comprising:

a panel processor;

a network processor coupled between the panel processor and an a TCP/IP switch; and first and second transceivers coupled to the TCP/IP switch;

the fire panel having a normal operating mode and an emergency operating mode;

wherein in the normal operating mode, the panel processor is configured to receive an event signal from an initiation device via the first transceiver, and to command an alarm signal be sent to an adjacent network node via the TCP/IP switch and second transceiver; and wherein in the emergency operating mode, the panel processor is configured to receive an event signal from the initiation device via the first transceiver, and to transmit an alarm signal to the second panel transceiver via an emergency communication link that is different from a primary communication link containing the TCP/IP switch, and wherein the second panel transceiver is configured to transmit the alarm signal using an emergency communication protocol that is different from a primary communication protocol that is used in the normal operating mode.

20. The fire panel of claim 19, wherein the emergency communication link is part of an emergency interface.

21. The fire panel of claim 20, wherein the emergency interface includes an emergency interface processor.

22. A method for providing emergency communication in a networked alarm system, comprising:

receiving, at a panel processor associated with a first fire panel, an event signal from an initiation device; and transmitting, from the panel processor, an alarm signal to a panel transceiver via an emergency interface, said alarm signal representative of said event signal, wherein the alarm signal is transmitted to the panel transceiver on a communication link that is different from a primary alarm signal communication link of said first fire panel;

wherein the panel transceiver is a DSL transceiver, and the alarm signal comprises a short between first and second wires of a wire pair.

23. A system for providing emergency communication in a networked alarm system, comprising:

a panel processor and a first panel transceiver associated with a first panel, the panel processor configured to receive an event signal from an initiation device;

the panel processor coupled to the panel transceiver via first and second communication links, the first communication link comprising a normal communication link, the second communication link comprising an emergency communication link, the first and second communication links being physically separate communication links;

wherein the alarm signal is representative of the event signal; and wherein the first panel transceiver is a DSL transceiver, and the alarm signal comprises a short between first and second wires of a wire pair.

* * * * *